US010577217B1

(12) United States Patent
Feng

(10) Patent No.: US 10,577,217 B1
(45) Date of Patent: Mar. 3, 2020

(54) YARN FEEDER

(71) Applicant: Shen-Te Feng, Taichung (TW)

(72) Inventor: Shen-Te Feng, Taichung (TW)

(73) Assignee: Sunshine Kinetics Technology Co., Ltd., Taichung (TW)

( * ) Notice: Subject to any disclaimer, the term of this patent is extended or adjusted under 35 U.S.C. 154(b) by 0 days.

(21) Appl. No.: 16/147,121

(22) Filed: Sep. 28, 2018

(51) Int. Cl.
*B65H 75/24* (2006.01)

(52) U.S. Cl.
CPC ..... *B65H 75/248* (2013.01); *B65H 75/245* (2013.01); *B65H 2701/31* (2013.01)

(58) Field of Classification Search
CPC . B65H 75/245; B65H 75/285; B65H 2701/31
See application file for complete search history.

(56) References Cited

U.S. PATENT DOCUMENTS 970,745 A * 9/1910 Oskrit ..... 242/571.5
1,539,972 A * 6/1925 Todd ..... B65H 75/245 242/130.1
2,248,716 A * 7/1941 Markle, Jr. ..... B65H 75/245 242/571.5
2,549,618 A * 4/1951 McBride ..... B65H 49/06 242/130.1
3,297,270 A * 1/1967 Larsen ..... B65H 75/245 242/530.3
3,946,958 A * 3/1976 Chavis ..... B65H 75/245 242/573.9
5,217,175 A * 6/1993 Stitz ..... B65H 54/543 242/571.8
5,297,671 A * 3/1994 Ruth ..... B65H 49/06 198/465.1

* cited by examiner

*Primary Examiner* — William E Dondero
(74) *Attorney, Agent, or Firm* — Che-Yang Chen; Law Offices of Scott Warmuth

(57) ABSTRACT

A yarn feeder may comprise a winding wheel, a driving member, at least a locating member, and a plurality of tension pieces. The winding wheel has a first end and a second end, and a plurality of locating holes are formed on the winding wheel adjacent to the first end. The driving member has a ring coupled with the second end of the winding wheel, and the ring comprises at least a driving rod extended along an outer surface of the winding wheel from the second end to the first end, and an end of the driving rod close to the first end which comprises a driving portion and a connecting portion thereon. The locating member comprises a shell, a pivot shaft, a first column, and a locating column. The tension pieces are respectively connected between the ring of the driving member and the first end of the winding wheel.

10 Claims, 10 Drawing Sheets

YARN FEEDER

FIELD OF THE INVENTION

The present invention relates to a yarn feeder and more particularly to an automatic-tension-control yarn feeder.

BACKGROUND OF THE INVENTION

Generally, there are two kinds of winding wheels for a yarn feeder which are fixed tension and variable tension. For the fixed tension winding wheel, the winding wheel has a wheel body, and two ends of outer edge thereof respectively have a plurality of metal pieces secured thereon. Each of the metal pieces has an elastic protruding portion at a middle section thereof which is configured to be abutted by a yarn roll so as to secure a position of the yarn roll. The fixed tension yarn feeder has the advantages of simple structure, low cost and is less likely to damage than the variable tension yarn feeder. However, the fixed tension yarn feeder has its shortcomings that when the winding wheel has excessive tension, the yarn roll is difficult to sleeve in and out of the winding wheel, and, on the contrary, when the winding wheel has insufficient tension, the yarn roll may slip related to the winding wheel so that the yarn extraction cannot be precisely controlled. Therefore, the variable tension yarn feeder becomes more used by manufacturers. The variable tension yarn feeder also has a plurality of metal pieces secured on two ends of the winding wheel. The initial positions of the metal pieces are not protruded, and after the yarn roll sleeves on the winding, the metal pieces are controlled through an oil hydraulic pump so as to control the tension between the winding wheel and the yarn roll.

However, the conventional variable tension yarn feeder is disadvantageous because: (i) the variable tension yarn feeder has complicate structure, and the pipes of the oil hydraulic pump are easily stuck so as to damage the winding wheel; and (ii) the oil hydraulic pump needs additional oil pressure system for control, and after yarn roll is sleeved on the winding wheel, a user still needs to operate the oil pressure system to secure the yarn roll, which is inconvenience for operation. Therefore, there remains a need for a new and improved design for a yarn feeder to overcome the problems presented above.

SUMMARY OF THE INVENTION

The present invention provides a yarn feeder which comprises a winding wheel, a driving member, at least a locating member, and a plurality of tension pieces. The winding wheel formed in tube shape has a first end and a second end, and a plurality of locating holes are formed on the winding wheel adjacent to the first end, and the locating holes are aligned in axial direction on the winding wheel. The driving member has a ring which is configured to couple with the second end of the winding wheel, and the ring comprises at least a driving rod extended along an outer surface of the winding wheel from the second end to the first end. Furthermore, the driving rod has an end close to the first end which comprises a driving portion and a connecting portion thereon. The driving member is adapted to be driven through the driving portion to move toward the first end of the winding wheel. The locating member comprises a shell, a pivot shaft, a first column, and a locating column. The shell has a first housing and a second housing, and the first housing and the second housing faced to the same direction respectively have a second through hole and a third through hole thereon. Moreover, each of two lateral sides of the second through hole has a board body extended from the second through hole, and each of the board bodies has an axle hole penetrating therethrough. The locating member is configured to install on the connecting portion through the two board bodies coupled at two lateral sides of the connecting portion, and the pivot shaft is adapted to penetrate through the axle hole and the connecting portion. In addition, the first column is installed in the first housing, and a first elastic member installed between the first column and the shell is configured to push the first column to penetrate through the second through hole of the first housing and keep the movable first column to stand out of the second through hole. The locating column is installed in the second housing, and a second elastic member is installed between the locating column and the shell. The second elastic member is adapted to push the locating column to penetrate through the third through hole of the second housing, and locating column is configured to be selectively inserted into one of the locating holes. The tension pieces are respectively connected between the ring of the driving member and the first end of the winding wheel.

In one embodiment, each of the locating holes comprises a guiding surface and an abutting surface therein which are respectively faced toward the first end and the second end.

In another embodiment, each of the first column and the locating column has an end formed in a round head, and the other end of the first column comprises a first flange while the other end of the locating column has a second flange; the first flange has an outer diameter larger than the second through hole while the second flange comprises an outer diameter larger than the third through hole so as to respectively limit the first column and the locating column in the first housing and the second housing.

In still another embodiment, the shell is formed from two identical pieces fitting together, and the two pieces are secured by a plurality of bolts.

In a further embodiment, the winding wheel comprises a plurality of axial grooves thereon, and each of the grooves is positioned from the first end toward the second end, and a protruding portion is formed at an inner edge of the driving rod of the driving member, and protruding portion is slidably coupled in the groove so as to enable the winding wheel and the driving member to have synchronous rotation.

In still a further embodiment, each of the tension pieces is a metal strip formed in a convex arc shape, and two ends of the tension piece are respectively secured on the ring and the first end of the winding wheel through two locating pieces.

In yet a further embodiment, each of the tension pieces has a locating track and an elastic strip; an end of the locating track is secured on the first end of the winding wheel, and the other end thereof penetrates through and couples with the ring of the driving member; the elastic strip is positioned in the locating track, and when the driving member moves toward the first end of the winding wheel, the ring is configured to press the elastic strip, and the elastic strip is adapted to protrude out from the locating track.

In a particular embodiment, the ring has a plurality of first through holes, and each of the first through holes has a driving blocks protruding from an edge thereof; the locating track is configured to penetrate through the first through hole, and the driving block is coupled and slidable in the locating track to press the elastic strip.

In another particular embodiment, an inner threaded section is formed at an inner periphery of the second end of the winding wheel, and a cover connected to the second end of the winding wheel through the inner threaded section is adapted to block the locating track at an outer surface of the driving member such that the locating track and the driving member are secured between the first end and the second end of the winding wheel.

In still another particular embodiment, each of two top ends of two lateral sides of the locating track is bent inwardly to form a blocking piece; the elastic strip has at least a recess portion for installing the sliding piece, and the sliding piece has two wing portions which respectively abut against two inner edges of the two blocking pieces; the sliding piece is configured to divide the elastic strip into two sections so as to effectively control the deformation direction and extent of the elastic strip.

Comparing with conventional yarn feeder, the present invention is advantageous because: when the yarn roll is coupled with the locating member, the shell is pressed to move the first column downwardly so as to control the locating column to press against the outer surface of the winding wheel, and the first elastic member and the second elastic member are pressed; when the yarn roll goes further, the yarn roll is configured to push the driving portion, and through the driving rod, the driving portion is adapted to drive the ring to move from the second end of the winding wheel to the first end thereof, and the locating member is synchronously moved toward the first end of the winding wheel; when the locating column of the locating member is aligned with one of the locating holes of the winding wheel, the second elastic member is adapted to push the locating column to insert into the locating hole, and thereafter the abutting surface is configured to block the locating column so as to prevent the ring from moving back toward the second end of the winding wheel; when the distance between the ring and the first end is decreased, the tension pieces therebetween are squeezed and extended outwardly so as to bear against an inner edge of the yarn roll such that the tension pieces only extend outwardly when the yarn roll is completely sleeved on the winding wheel, thereby achieving the effect of securing the yarn roll without external force.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
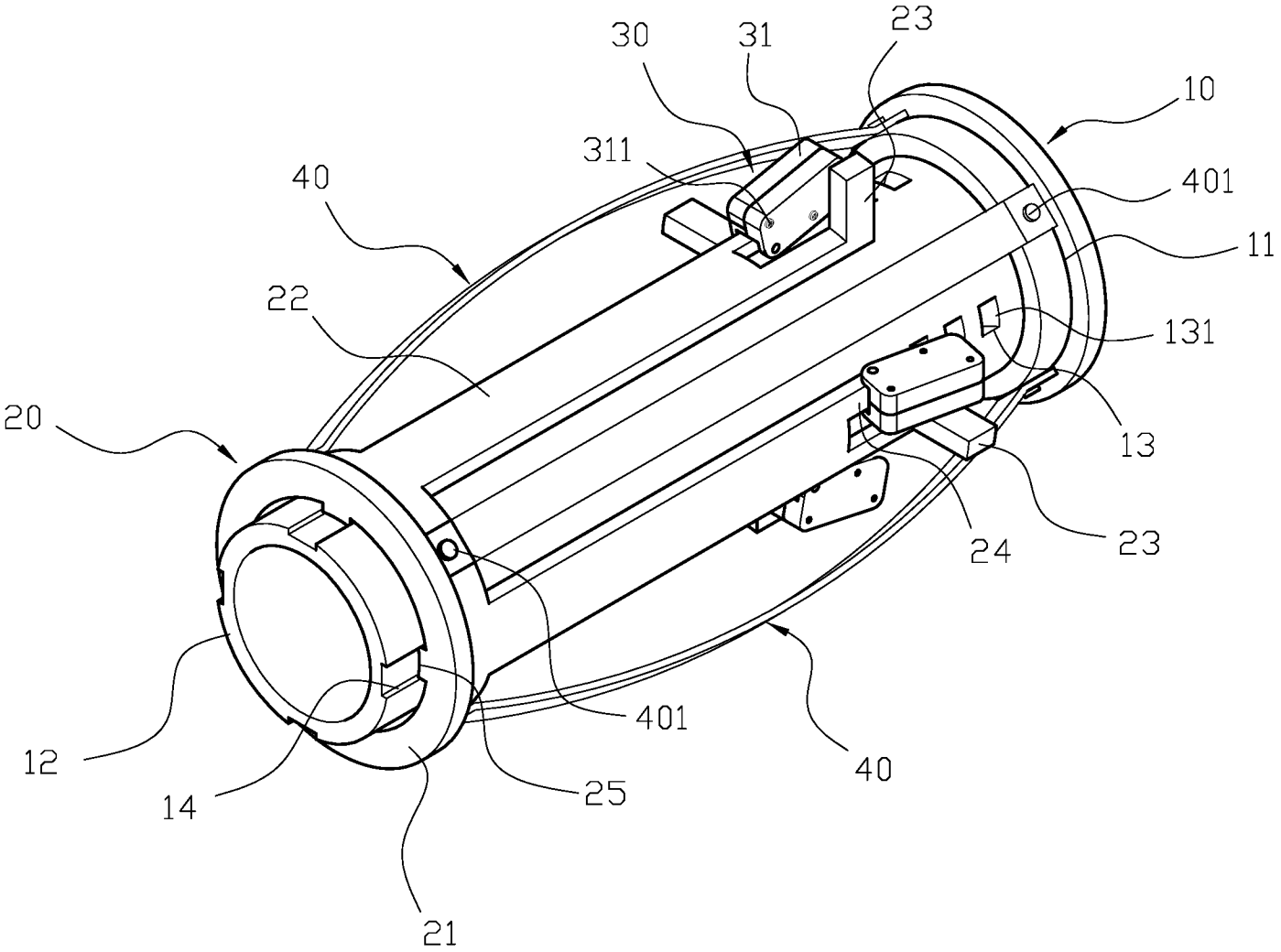
FIG. 1 is a three-dimensional assembly view of a yarn feeder of the present invention.
Figure 2:
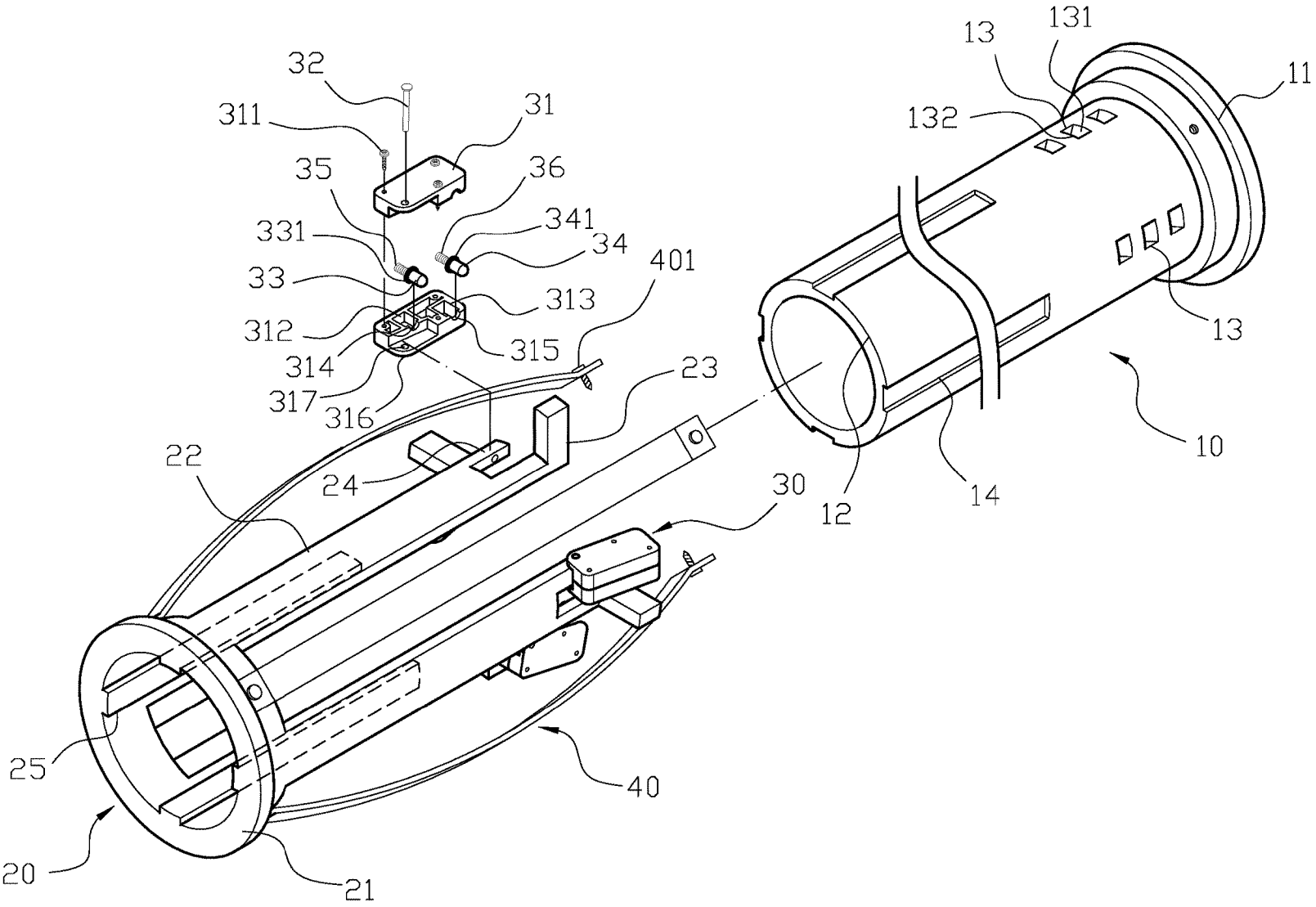
FIG. 2 is a three-dimensional exploded view of the yarn feeder of the present invention.
Figure 3:
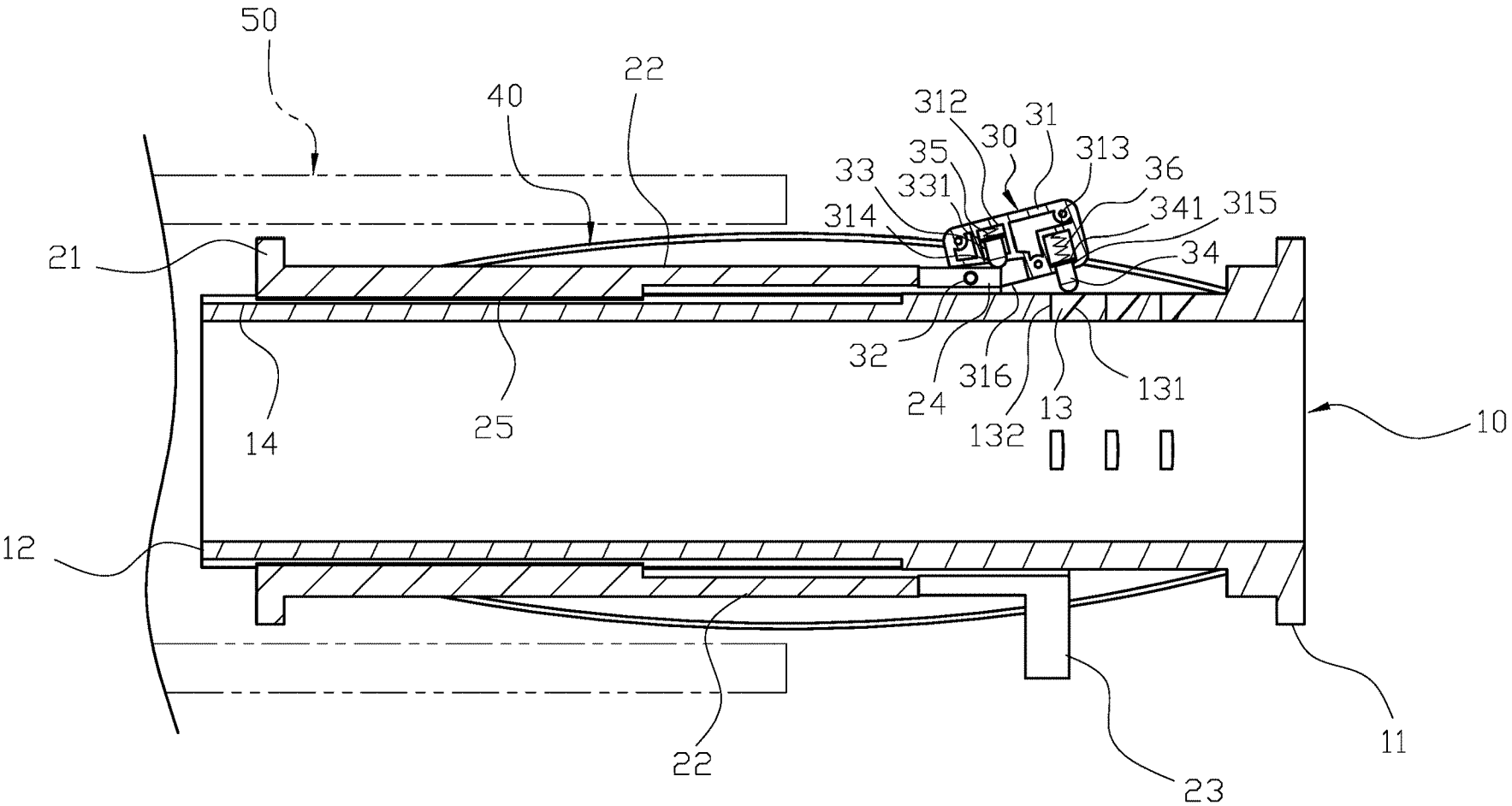
FIG. 3 is a sectional view of the yarn feeder of the present invention.
Figure 4:
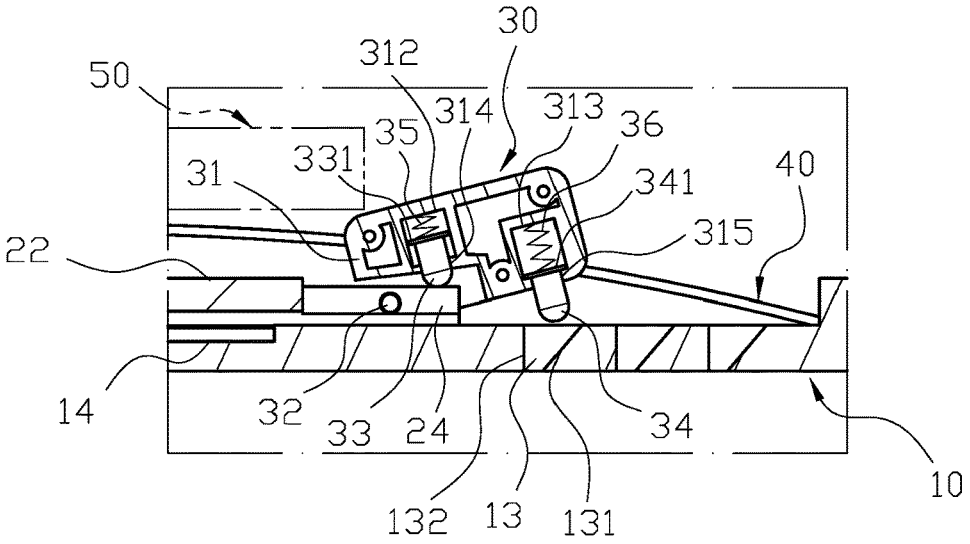
FIG. 4 is a first schematic view illustrating a yarn roll is sleeved on a winding wheel of the yarn feeder in the present invention.
Figure 5:
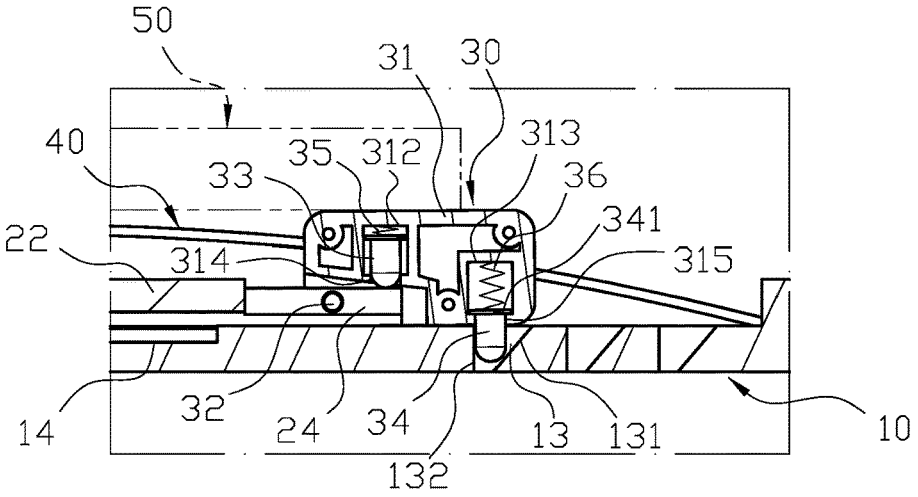
FIG. 5 is a second schematic view illustrating the yarn roll is sleeved on the winding wheel of the yarn feeder in the present invention.
Figure 6:
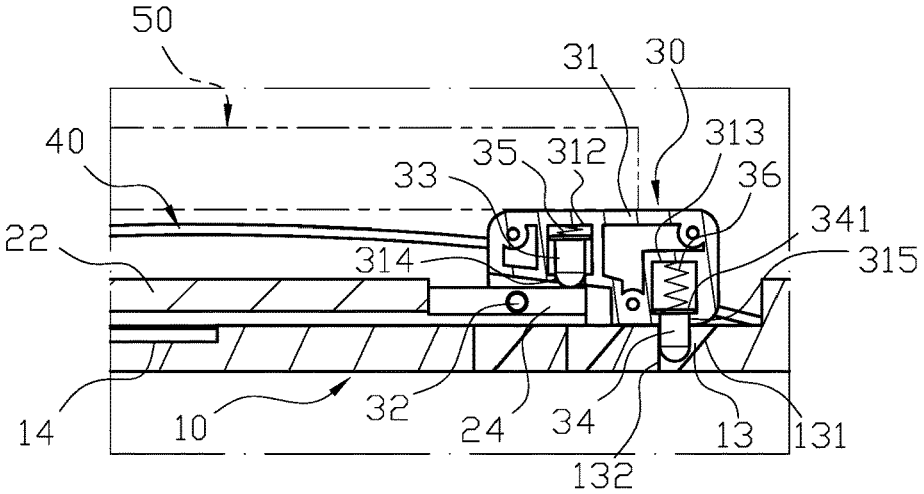
FIG. 6 is a third schematic view illustrating the yarn roll is sleeved on the winding wheel of the yarn feeder in the present invention.
Figure 7:
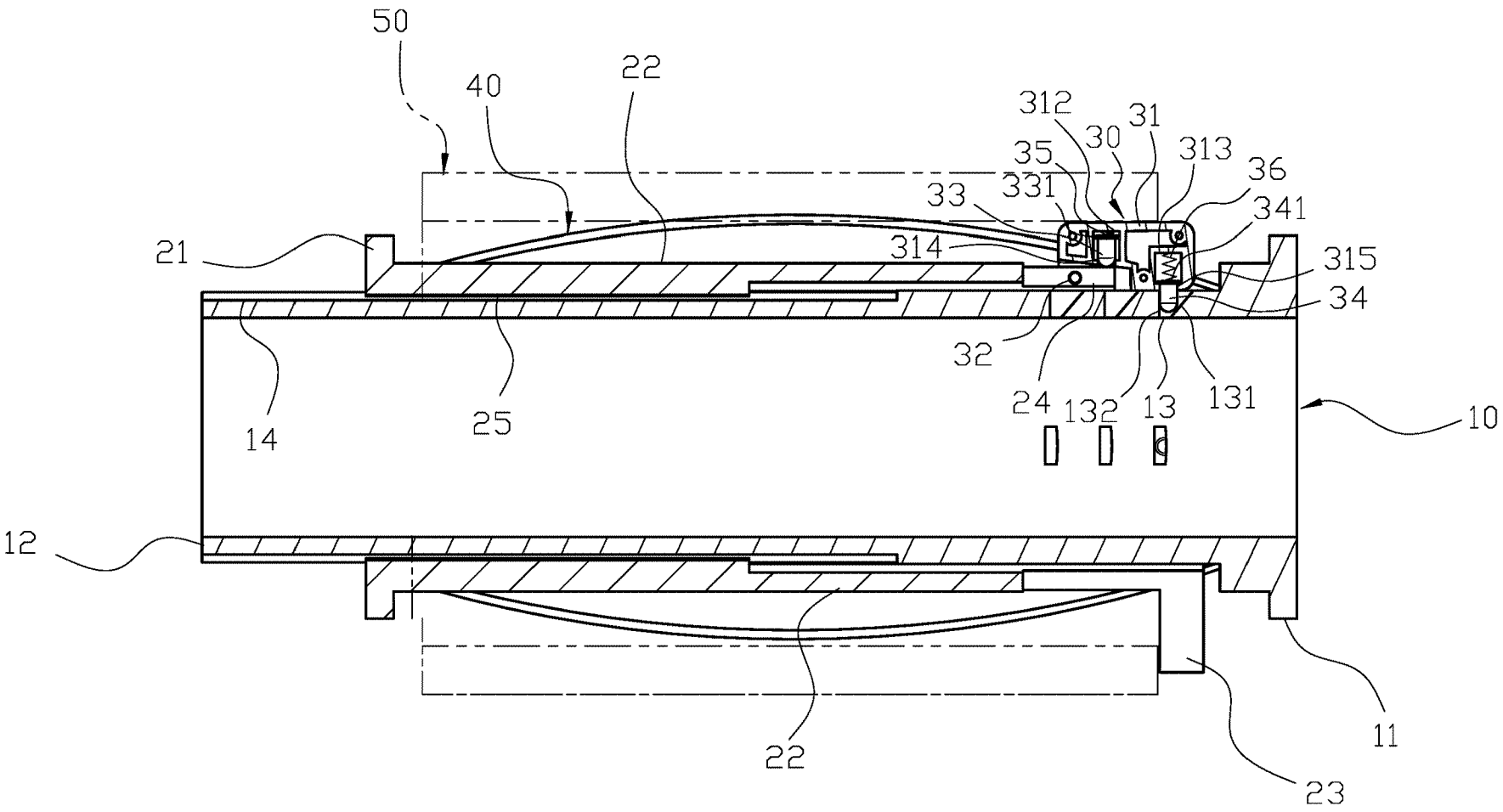
FIG. 7 is a fourth schematic view illustrating the yarn roll is sleeved on the winding wheel of the yarn feeder in the present invention.
Figure 8:
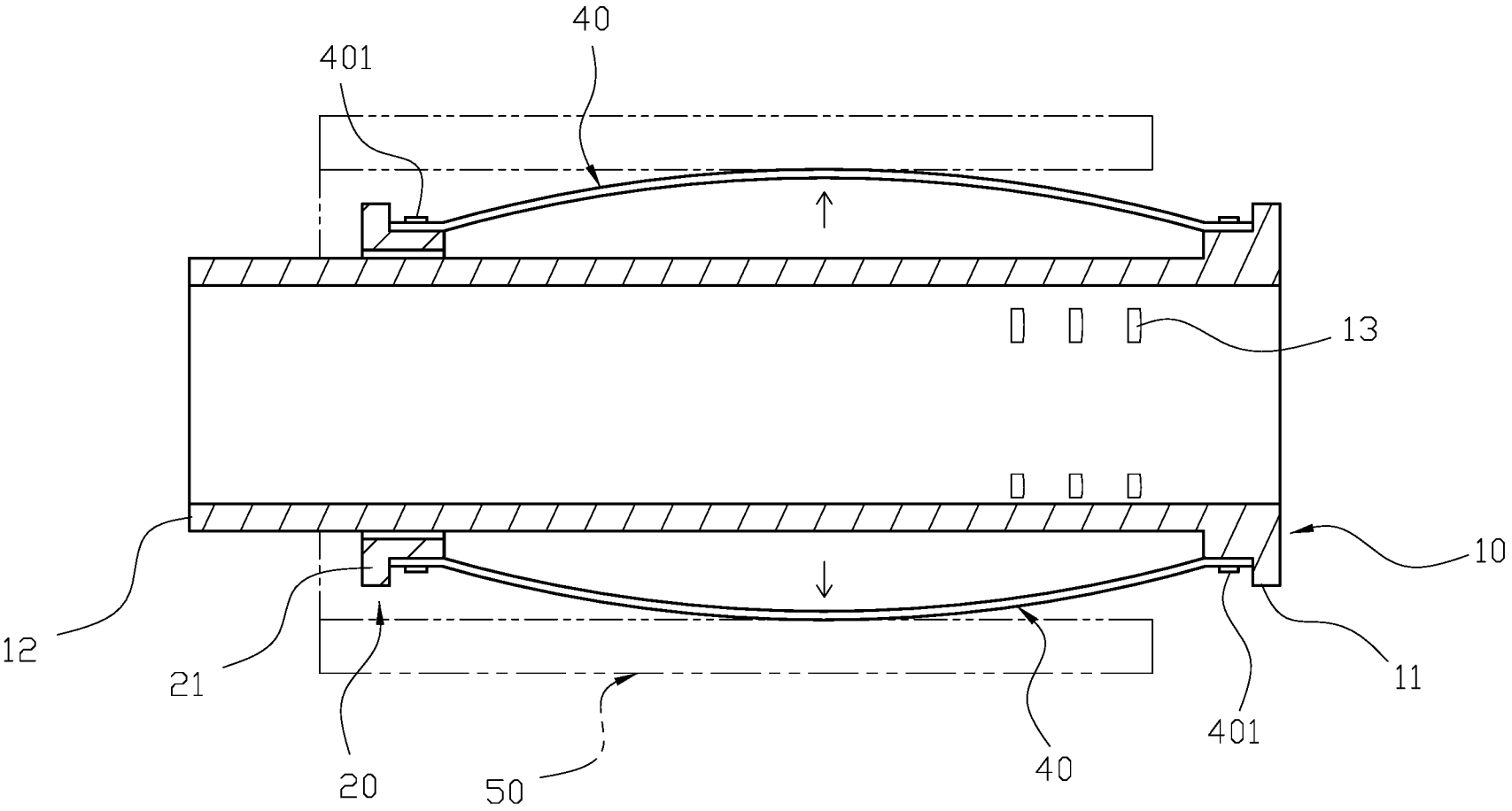
FIG. 8 is a schematic view illustrating a plurality of tension pieces of the yarn feeder secure the yarn roll in the present invention.

In order to further understand the goal, characteristics and effect of the present invention, a number of embodiments along with the drawings are illustrated as following:

Referring to FIGS. 1 to 3, the present invention provides a yarn feeder which comprises a winding wheel (10), a driving member (20), at least a locating member (30), and a plurality of tension pieces (40). The winding wheel (10) formed in tube shape has a first end (11) and a second end (12), and a plurality of locating holes (13) are formed on the winding wheel (10) adjacent to the first end (11). The locating holes (13) are aligned in axial direction on the winding wheel (10), and each of the locating holes (13) comprises a guiding surface (131) and an abutting surface (132) therein which are respectively faced toward the first end (11) and the second end (12). Moreover, the winding wheel (10) comprises a plurality of axial grooves (14) thereon, and each of the grooves (14) is positioned from the first end (11) toward the second end (12). The driving member (20) has a ring (21) which is configured to couple with the second end (12) of the winding wheel (10), and the ring (21) comprises at least a driving rod (22) extended along an outer surface of the winding wheel (10) from the second end (12) to the first end (11). Furthermore, the driving rod (22) has an end close to the first end (11) which comprises a driving portion (23) and a connecting portion (24) thereon. The driving member (20) is adapted to be driven through the driving portion (23) to move toward the first end (11) of the winding wheel (10). A protruding portion (25) is formed at an inner edge of the driving rod (22) of the driving member (20), and protruding portion (25) is slidably coupled in the groove (14) so as to enable the winding wheel (10) and the driving member (20) to have synchronous rotation. The locating member (30) comprises a shell (31), a pivot shaft (32), a first column (33), and a locating column (34). The shell (31) is formed from two identical pieces fitting together, and the two pieces are secured by a plurality of bolts (311). Also, the shell (31) has a first housing (312) and a second housing (313), and the first housing (312) and the second housing (313) faced to the same direction respectively have a second through hole (314) and a third through hole (315) thereon. Moreover, each of two lateral sides of the second through hole (314) has a board body (316) extended from the second through hole (314), and each of the board bodies (316) has an axle hole (317) penetrating therethrough. The locating member (30) is configured to install on the connecting portion (24) through the two board bodies (316) coupled at two lateral sides of the connecting portion (24), and the pivot shaft (32) is adapted to penetrate through the axle hole (317) and the connecting portion (24) so as to pivotally connect the locating member (30) on the connecting portion (24). In addition, the first column (33) is installed in the first housing (312), and a first elastic member (35) installed between the first column (33) and the shell (31) is configured to push the first column (33) to penetrate through the second through hole (314) of the first housing (312) and keep the movable first column (33) to stand out of the second through hole (314). The locating column (34) is installed in the second housing (313), and a second elastic member (36) is installed between the locating column (34) and the shell (31). The second elastic member (36) is adapted to push the locating column (34) to penetrate through the third through hole (315) of the second housing (313), and locating column (34) is configured to be selectively inserted into one of the locating holes (13). Each of the first column (33) and the locating column (34) has an end formed in a round head, and the other end of the first column (33) comprises a first flange (331) while the other end of the locating column (34) has a second flange (341). Also, the first flange (331) has an outer diameter larger than the second through hole (314) while the second flange (341) comprises an outer diameter larger than the third through hole (315) so as to respectively limit the first column (33) and the locating column (34) in the first housing (312) and the second housing (313). The tension pieces (40) are respectively connected between the ring (21) of the driving member (20) and the first end (11) of the winding wheel (10), and each of the tension pieces (40) is a metal strip formed in a convex arc shape. Furthermore, two ends of the tension piece (40) are respectively secured on the ring (21) and the first end (11) of the winding wheel (10) through two locating pieces (401), and when the distance between the ring (21) and the first end (11) is decreased, the tension piece (40) is squeezed to extend outwardly so as to achieve the effect of variable tension for a yarn roll.

Structurally, referring to FIGS. 1 to 3, the first column (33) is installed in the first housing (312) of the shell (31) of the locating member (30), and the first elastic member (35) is installed between the shell (31) and the first column (33), and an end of the first column (33) is configured to stick out of the second through hole (314). Similarly, the locating column (34) is installed in the second housing (313) of the shell (31), and the second elastic member (36) is installed between the shell (31) and the locating column (34), and an end of the locating column (34) is adapted to stick out of the third through hole (315). Thereafter, the two pieces of the shell (31) is configured to be fit and secured together through the bolts (311), and the first column (33) and the locating column (34) are adapted to respectively penetrate through the second through hole (314) and the third through hole (315), and the first flange (331) and the second flange (341) are respectively abutted against the first housing (312) and the second housing (313) around the second through hole (314) and the third through hole (315). Additionally, the pivot shaft (32) penetrates through the axle hole (317) of the locating member (30) and the connecting portion (24) so as to connect the locating member (30) with the connecting portion (24). The first column (33) is configured to bear against the connecting portion (24), and the ring (21) of the driving member (20) is engaged with the second end (12) of the winding wheel (10), and the driving rod (22) is adapted to extend toward the first end (11) of the winding wheel (10). Also, the protruding portion (25) is slidably coupled in the groove (14) of the winding wheel (10), and the locating member (30) is located at a position axially aligned with the locating holes (13). The two ends of the tension piece (40) are respectively secured on the ring (21) and the first end (11) of the winding wheel (10) through two locating pieces (401).

Figure 9:
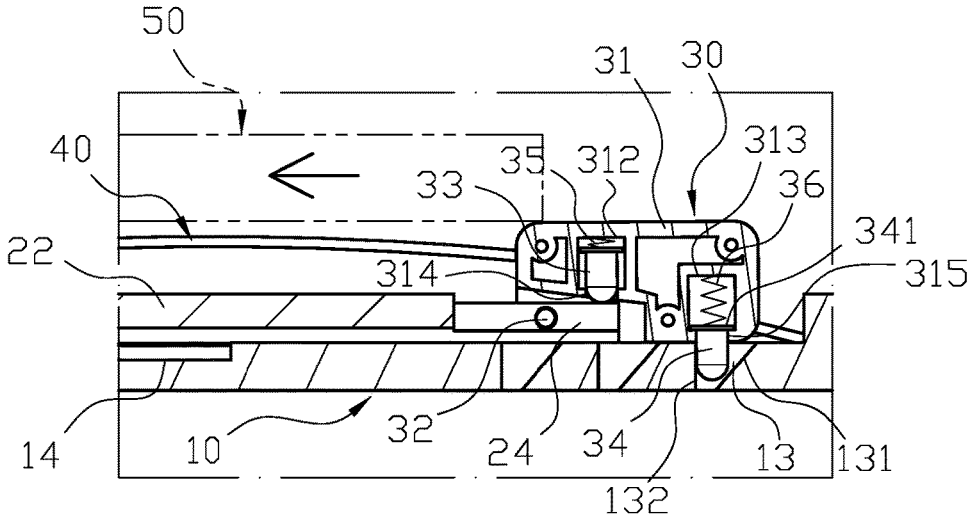
FIG. 9 is a first schematic view illustrating the yarn roll is pulled out of the winding wheel of the yarn feeder in the present invention.
Figure 10:
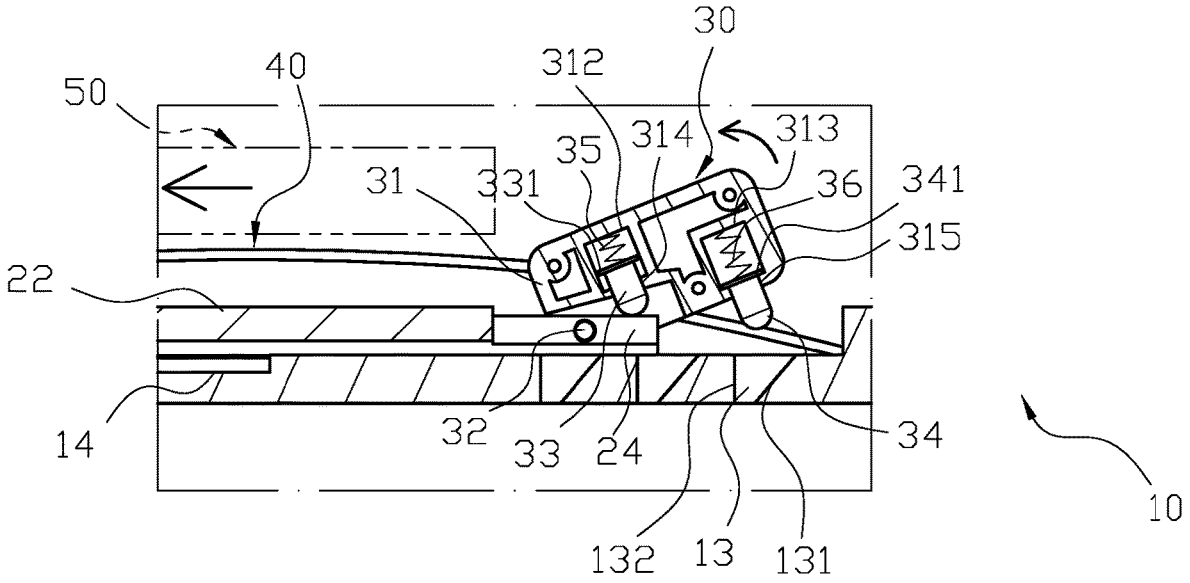
FIG. 10 is a second schematic view illustrating the yarn roll is pulled out of the winding wheel of the yarn feeder in the present invention.

In actual application, referring to FIGS. 2 to 8, the winding wheel (10) is rotated by a motor which is installed inside or outside the winding wheel (10), and the connection structure between the motor and the winding wheel (10) is not described because there is no new method for driving the winding wheel (10) by the motor. A yarn roll (50) is sleeved on the winding wheel (10) to have synchronous rotate so as to achieve yarn extraction. When the yarn roll (50) is sleeved on the winding wheel (10), the yarn roll (50) is coupled with the driving member (20) and each of the tension pieces (40) has no contact or slight contact to the yarn roll (50) such that the yarn roll (50) can be easily sleeved on the winding wheel (10). When the yarn roll (50) is coupled with the locating member (30), the shell (31) is pressed to move the first column (33) downwardly so as to control the locating column (34) to press against the outer surface of the winding wheel (10), and the first elastic member (35) and the second elastic member (36) are pressed. When the yarn roll (50) goes further, the yarn roll (50) is configured to push the driving portion (23), and through the driving rod (22), the driving portion (23) is adapted to drive the ring (21) to move from the second end (12) of the winding wheel (10) to the first end (11) thereof. Meanwhile, the locating member (30) is synchronously moved toward the first end (11) of the winding wheel (10). When the locating column (34) of the locating member (30) is aligned with one of the locating holes (13) of the winding wheel (10), the second elastic member (36) is adapted to push the locating column (34) to insert into the locating hole (13), and thereafter the abutting surface (132) is configured to block the locating column (34) so as to prevent the ring (21) from moving back toward the second end (12) of the winding wheel (10). Also, when the distance between the ring (21) and the first end (11) is decreased, the tension pieces (40) therebetween are squeezed and extended outwardly so as to bear against an inner edge of the yarn roll (50). As a result, the tension pieces (40) only extend outwardly when the yarn roll (50) is completely sleeved on the winding wheel (10), thereby achieving the effect of securing the yarn roll (50) without external force. Moreover, after the tension pieces (40) bear against the yarn roll (50), the winding wheel (10) and the driving member (20) is configured to have synchronous rotation so as to drive the yarn roll (50) and achieve the yarn extraction. Furthermore, the protruding portion (25) of the driving member (20) is engaged with the groove (14) of the winding wheel (10) so as to effectively prevent the tension pieces (40) from deformation during rotation process. More specifically, when the tension pieces (40) fails to generate sufficient tension to fix the yarn roll (50), the tension pieces (40) is adapted to push the yarn roll (50) so as to move the driving member (20) closer to the first end (11) of the winding wheel (10), and the locating column (34) is adapted to move inwardly along the guiding surface (131) of the locating hole (13) and slide into another locating hole (13) more closer to the first end (11) of the winding wheel (10), thereby achieving the effect of adjusting tension. Referring to FIGS. 9 and 10, when the yarn roll (50) is axially pulled out of the winding wheel (10) with an external force, the yarn roll (50) is adapted to slide off from the locating member (30), and the first elastic member (35) is configured to push the first column (33) to bear against the connecting portion (24) such that the locating member (30) is adapted to take the pivot shaft (32) as axis to have rotation outward so as to enable the locating column (34) to depart from the locating hole (13). At this time, the first elastic member (35) and the second elastic member (36) are not pressed, and the elastic force of the tension pieces (40) are adapted to push the driving member (20) toward the second end (12) of the winding wheel (10) so as to release the yarn roll (50) from pushing force from the tension pieces (40). Thereafter, the yarn roll (50) is easily pulled out from the winding wheel (10).

Figure 11:
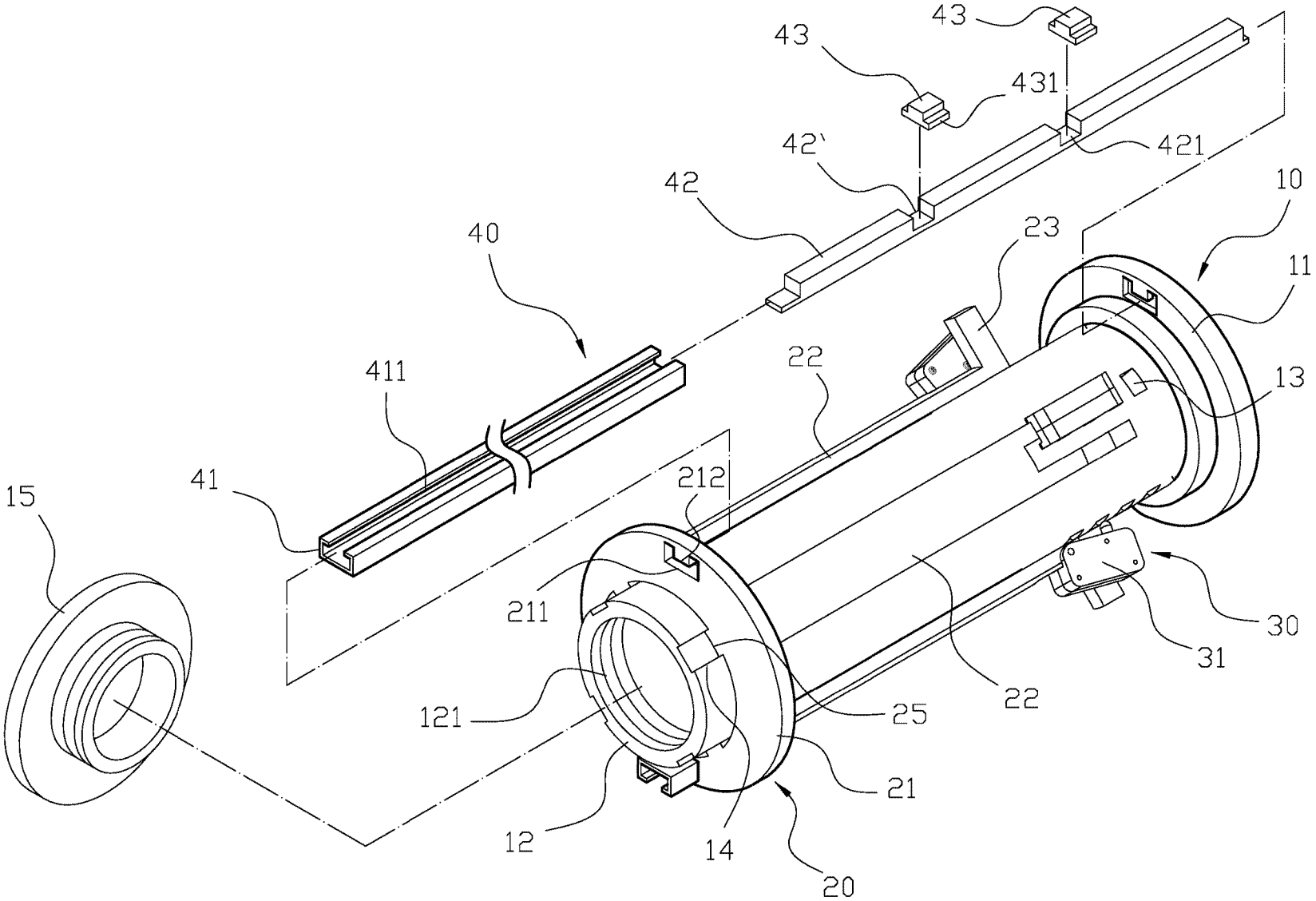
FIG. 11 is a three-dimensional exploded view of a second embodiment of the yarn feeder of the present invention.
Figure 12:
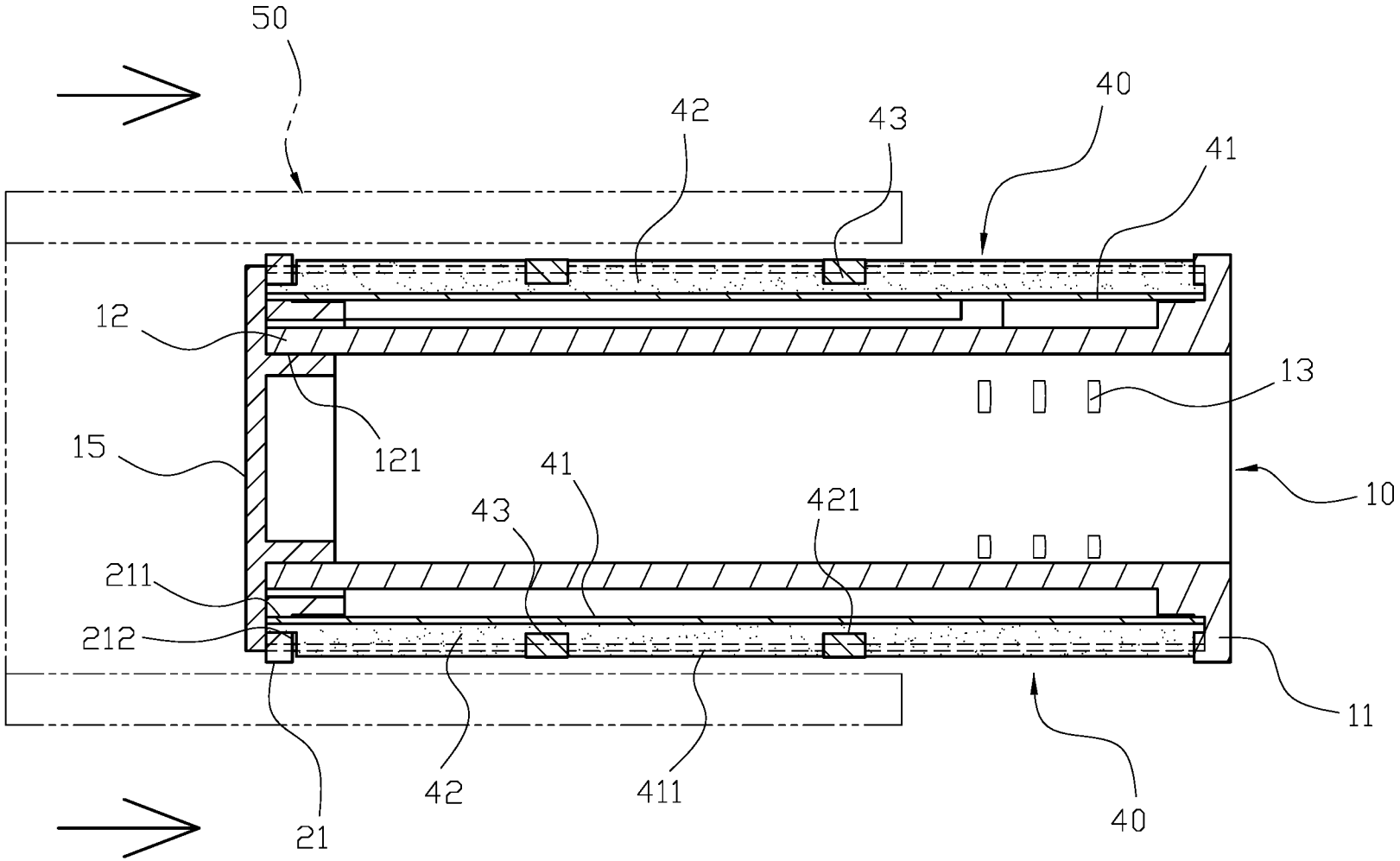
FIG. 12 is a schematic view illustrating the yarn roll is sleeved on the winding wheel of the second embodiment of the yarn feeder in the present invention.
Figure 13:
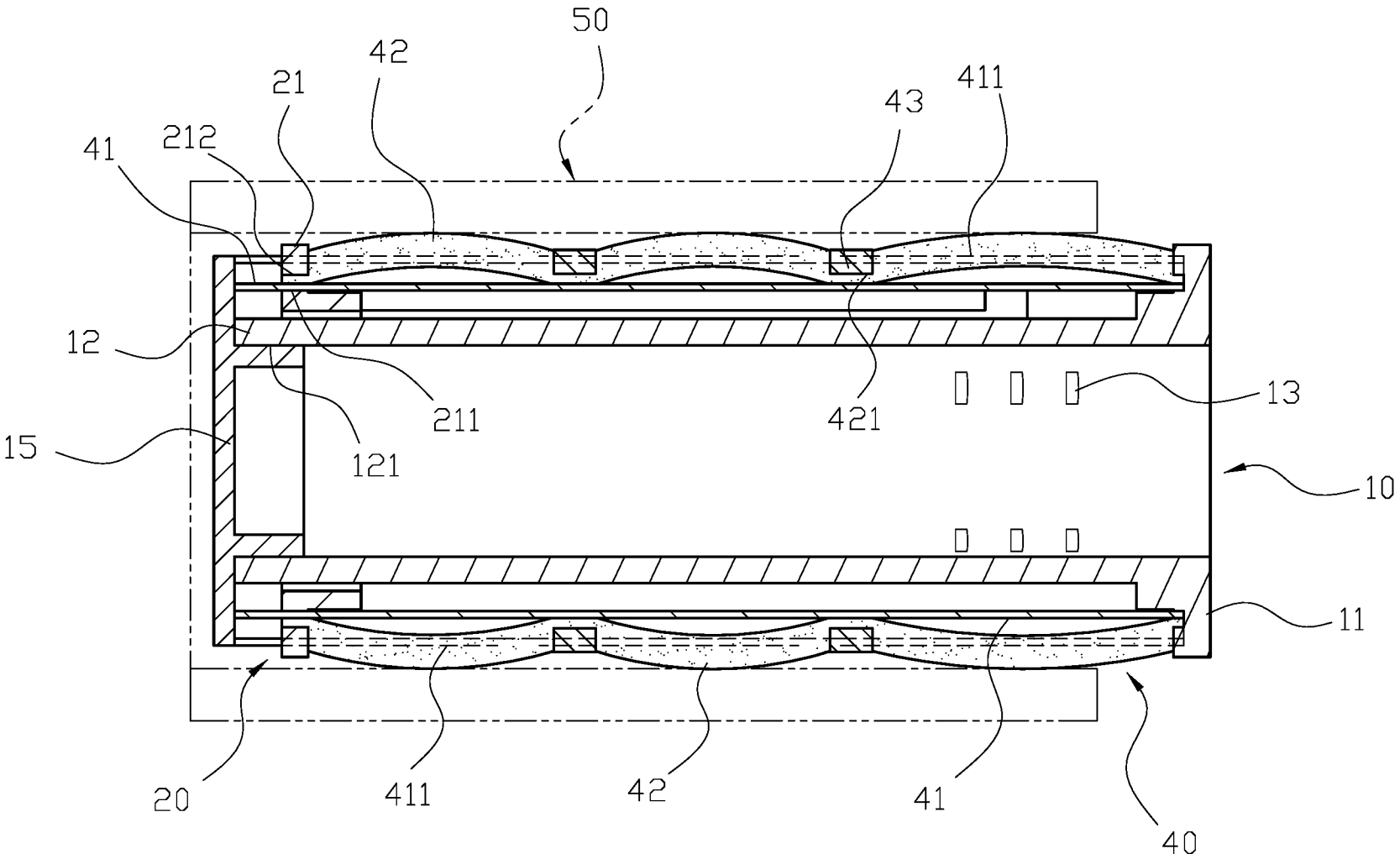
FIG. 13 is a schematic view illustrating the tension pieces of the yarn feeder of the second embodiment of the yarn feeder secure the yarn roll in the present invention.

In another embodiment, referring to FIGS. 11 to 13, each of the tension pieces (40) has a locating track (41), an elastic strip (42) and at least a sliding piece (43). An end of the locating track (41) is secured on the first end (11) of the winding wheel (10), and the other end thereof penetrates through and couples with the ring (21) of the driving member (20). The elastic strip (42) is positioned in the locating track (41) so as to enable the driving member (20) to move toward the first end (11) of the winding wheel (10) in a way that the yarn roll (50) pushes the driving portion (23). Meanwhile, the ring (21) is configured to press the elastic strip (42), and the elastic strip (42) is adapted to protrude out from the locating track (41), and the locating member (30) is configured to insert into the locating hole (13) of the winding wheel (10) such that the elastic strip (42) is adapted to bear against the inner edge of the yarn roll (50). Furthermore, the ring (21) has a plurality of first through holes (211), and each of the first through holes (211) has a driving blocks (212) protruding from an edge thereof. The locating track (41) is configured to penetrate through the first through hole (211), and the driving block (212) is coupled and slidable in the locating track (41) to press the elastic strip (42). Moreover, an inner threaded section (121) is formed at an inner periphery of the second end (12) of the winding wheel (10), and a cover (15) connected to the second end (12) of the winding wheel (10) through the inner threaded section (121) is adapted to block the locating track (41) at an outer surface of the driving member (20) such that the locating track (41) and the driving member (20) are secured between the first end (11) and the second end (12) of the winding wheel (10). Also, each of two top ends of two lateral sides of the locating track (41) is bent inwardly to form a blocking piece (411). The elastic strip (42) has at least a recess portion (421) for installing the sliding piece (43), and the sliding piece (43) has two wing portions (431) which respectively abut against two inner edges of the two blocking pieces (411). The sliding piece (43) is configured to divide the elastic strip (42) into two sections so as to effectively control the deformation direction and extent of the elastic strip (42).

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A yarn feeder comprising, a winding wheel, which is formed in tube shape, having a first end and a second end, and a plurality of locating holes formed on the winding wheel adjacent to the first end, and the locating holes aligned in axial direction on the winding wheel;

a driving member having a ring which is configured to couple with the second end of the winding wheel, and the ring comprising at least a driving rod extended along an outer surface of the winding wheel from the second end to the first end; the driving rod having an end close to the first end which comprises a driving portion and a connecting portion thereon; the driving member adapted to be driven through the driving portion to move toward the first end of the winding wheel;

at least a locating member comprising a shell, a pivot shaft, a first column, and a locating column; the shell having a first housing and a second housing, and the first housing and the second housing, which are faced to the same direction, respectively having a second through hole and a third through hole thereon; each of two lateral sides of the second through hole having a board body extended from the second through hole, and each of the board bodies having an axle hole penetrating therethrough; the locating member installed on the connecting portion through the two board bodies coupled at two lateral sides of the connecting portion, and the pivot shaft adapted to penetrate through the axle hole and the connecting portion; the first column installed in the first housing, and a first elastic member, which is installed between the first column and the shell, configured to push the first column to penetrate through the second through hole of the first housing and keep the movable first column to stand out of the second through hole; the locating column installed in the second housing, and a second elastic member installed between the locating column and the shell; the second elastic member adapted to push the locating column to penetrate through the third through hole of the second housing, and locating column configured to be selectively inserted into one of the locating holes; and a plurality of tension pieces respectively connected between the ring of the driving member and the first end of the winding wheel, and when the distance between the ring and the first end decreased, the tension piece configured to be squeezed to extend outwardly so as to achieve the effect of variable tension for a yarn roll.

2. The yarn feeder of claim 1, wherein each of the locating holes comprises a guiding surface and an abutting surface therein which are respectively faced toward the first end and the second end.

3. The yarn feeder of claim 2, wherein each of the first column and the locating column has an end formed in a round head, and the other end of the first column comprises a first flange while the other end of the locating column has a second flange; the first flange has an outer diameter larger than the second through hole while the second flange comprises an outer diameter larger than the third through hole so as to respectively limit the first column and the locating column in the first housing and the second housing.

4. The yarn feeder of claim 3, wherein the shell is formed from two identical pieces fitting together, and the two pieces are secured by a plurality of bolts.

5. The yarn feeder of claim 1, wherein the winding wheel comprises a plurality of axial grooves thereon, and each of the grooves is positioned from the first end toward the second end, and a protruding portion is formed at an inner edge of the driving rod of the driving member, and protruding portion is slidably coupled in the groove so as to enable the winding wheel and the driving member to have synchronous rotation.

6. The yarn feeder of claim 1, wherein each of the tension pieces is a metal strip formed in a convex arc shape, and two ends of the tension piece are respectively secured on the ring and the first end of the winding wheel through two locating pieces.

7. The yarn feeder of claim 1, wherein each of the tension pieces has a locating track and an elastic strip; an end of the locating track is secured on the first end of the winding wheel, and the other end thereof penetrates through and couples with the ring of the driving member; the elastic strip is positioned in the locating track, and when the driving member moves toward the first end of the winding wheel, the ring is configured to press the elastic strip, and the elastic strip is adapted to protrude out from the locating track.

8. The yarn feeder of claim 7, wherein the ring has a plurality of first through holes, and each of the first through holes has a driving blocks protruding from an edge thereof; the locating track is configured to penetrate through the first through hole, and the driving block is coupled and slidable in the locating track to press the elastic strip.

9. The yarn feeder of claim 8, wherein an inner threaded section is formed at an inner periphery of the second end of the winding wheel, and a cover connected to the second end of the winding wheel through the inner threaded section is adapted to block the locating track at an outer surface of the driving member such that the locating track and the driving member are secured between the first end and the second end of the winding wheel.

10. The yarn feeder of claim 8, wherein each of two top ends of two lateral sides of the locating track is bent inwardly to form a blocking piece; the elastic strip has at least a recess portion for installing the sliding piece, and the sliding piece has two wing portions which respectively abut against two inner edges of the two blocking pieces; the sliding piece is configured to divide the elastic strip into two sections so as to effectively control the deformation direction and extent of the elastic strip.

* * * * *